US008029330B2

(12) United States Patent
Baytman et al.

(10) Patent No.: US 8,029,330 B2
(45) Date of Patent: Oct. 4, 2011

(54) DOLL WITH TWO CONDUCTOR TETHERED REMOTE CONTROL

(75) Inventors: Alexander L. Baytman, Fair Lawn, NJ (US); Albert J. Ferrigno, Garden City, NY (US); Charles R. Mahoney, South Orange, NJ (US); Konstantin Degtyarev, River Edge, NJ (US)

(73) Assignee: Mattel, Inc., El Segundo, CA (US)

( * ) Notice: Subject to any disclaimer, the term of this patent is extended or adjusted under 35 U.S.C. 154(b) by 976 days.

(21) Appl. No.: 11/934,999

(22) Filed: Nov. 5, 2007

(65) Prior Publication Data

US 2008/0090489 A1 Apr. 17, 2008

(51) Int. Cl.
*A63H 3/20* (2006.01)

(52) U.S. Cl. ..... 446/330; 446/175; 446/297

(58) Field of Classification Search ..... 446/158, 446/30–31, 454–456, 71, 72
See application file for complete search history.

(56) References Cited

U.S. PATENT DOCUMENTS

| | | | | |
|---|---|---|---|---|
| 1,654,068 | A | | 12/1927 | Blattner |
| 3,111,057 | A | | 11/1963 | Cramer |
| 3,163,077 | A | | 12/1964 | Shank |
| 3,223,412 | A | | 12/1965 | Freeman |
| 3,440,349 | A | | 4/1969 | Gibbs |
| 3,478,637 | A | | 11/1969 | Reed et al. |
| 3,845,468 | A | | 10/1974 | Smith |
| 3,867,786 | A | | 2/1975 | Greenblatt |
| 3,924,231 | A | | 12/1975 | McClure |
| 3,945,139 | A | | 3/1976 | Miller |
| 4,361,981 | A | | 12/1982 | Reiling et al. |
| 4,585,424 | A | * | 4/1986 | DeMars ..... 446/295 |
| 4,601,668 | A | | 7/1986 | Sirota |
| 4,642,710 | A | | 2/1987 | Murtha |
| 4,771,280 | A | | 9/1988 | Molinaro |
| 5,024,626 | A | * | 6/1991 | Robbins et al. ..... 446/409 |
| 5,277,645 | A | | 1/1994 | Kelley et al. |
| 5,365,149 | A | | 11/1994 | Blakeslee |
| 5,466,181 | A | | 11/1995 | Bennett |
| 5,503,583 | A | | 4/1996 | Hippely |
| 5,603,652 | A | | 2/1997 | Rothschild et al. |
| 5,619,182 | A | | 4/1997 | Robb |
| 5,791,965 | A | | 8/1998 | Kim |
| 5,902,166 | A | | 5/1999 | Robb |
| 6,011,489 | A | | 1/2000 | Kwan et al. |
| 6,048,209 | A | | 4/2000 | Bailey |
| 6,056,618 | A | | 5/2000 | Larian |
| 6,123,595 | A | | 9/2000 | Dean |
| 6,274,800 | B1 | | 8/2001 | Gardner |

(Continued)

*Primary Examiner* — Dmitry Suhol
*Assistant Examiner* — Alex F. R. P. Rada, II
(74) *Attorney, Agent, or Firm* — Panitch Schwarze Belisario & Nadel LLP

(57) ABSTRACT

A remote control unit is electrically connected to a toy only by a two conductor cord. An electronic control unit located within the toy includes a signal generator and a controller for receiving the output signals and controlling at least two actions of the toy by detecting predetermined period variations in the received output signals, a first action enabled by a first predetermined period variation and a second action enabled by a second predetermined period variation. The remote control unit is electrically connected to the signal generator only by the cord and includes a switch array having at least a first switch in parallel with a second switch so that when the first switch is closed to cause the first predetermined period variation and when the second switch is closed to cause the second predetermined period variation.

24 Claims, 3 Drawing Sheets

U.S. PATENT DOCUMENTS

| | | | | |
|---|---|---|---|---|
| 6,454,627 | B1 | 9/2002 | Mak | |
| 6,572,431 | B1 | 6/2003 | Maa | |
| 6,592,422 | B1 | 7/2003 | Rehkemper et al. | |
| 6,663,393 | B1 | 12/2003 | Ghaly | |
| 6,682,387 | B2 | 1/2004 | Choi | |
| 6,697,602 | B1 | 2/2004 | Ferrigno et al. | |
| 6,758,716 | B1 | 7/2004 | Rehkemper et al. | |
| 6,802,757 | B1 | 10/2004 | Sejnowski | |
| 6,851,999 | B2 | 2/2005 | Fong | |
| 2002/0106624 | A1* | 8/2002 | Chan | 434/393 |
| 2004/0017682 | A1 | 1/2004 | Baskies | |
| 2004/0067713 | A1 | 4/2004 | Fong | |
| 2004/0067714 | A1 | 4/2004 | Fong | |
| 2004/0077265 | A1 | 4/2004 | Ghaly | |
| 2007/0149091 | A1* | 6/2007 | Viohl | 446/484 |

* cited by examiner

DOLL WITH TWO CONDUCTOR TETHERED REMOTE CONTROL

CROSS-REFERENCE TO RELATED APPLICATIONS

This application claims the benefit of U.S. Provisional Patent Application No. 60/677,882 filed May 5, 2005 and entitled Doll with Tethered Remote Control, and Patent Cooperation Treaty Application Number PCT/US06/17365 filed May 5, 2006 entitled Doll with Tethered Remote Control, the entire subject matter of which are hereby incorporated herein by reference.

BACKGROUND OF THE INVENTION

The present invention relates to a remotely controlled apparatus and, more particularly to a toy doll having a tethered remote control connected by only a single pair of conductors.

It is known to provide devices, including dolls, with tethered remote controls having a plurality (an arbitrary number n) of switches contained therein. It is further known to connect such a tethered remote control to an electronic control unit which is capable of determining which of the plurality of switches has been activated. Conventional tethered remote controls typically employ a connection cord having n plus one separate conductors. A need exists for reducing the number of conductors required to transmit data from the tethered remote control to the electronic control unit to communicate the status of the switches contained in the remote control. A further need exists for a doll providing novel play activities.

BRIEF SUMMARY OF THE INVENTION

Briefly stated, in one embodiment, the present invention comprises a toy doll assembly including a toy doll and a separate tethered remote control unit electrically connected to the toy doll only by a two conductor cord comprising an electronic control unit within the toy doll, the electronic control unit including a signal generator for generating output signals and a controller for receiving the output signals and controlling at least two actions of the doll by detecting predetermined period variations in the received output signals, a first action being enabled upon the detection of a first predetermined period variation in the output signals and a second action being enabled upon the detection of a second predetermined period variation in the output signals, and the remote control unit electrically connected to the signal generator only by first and second electrical conductors of the cord, the remote control unit including a switch array having at least a first switch in series with a first resistance connected in parallel with a second switch in series with a second resistance, the switch array being connected between the first and second conductors so that when the first switch is closed the first resistance is connected between the first and second conductors and when the second switch is closed the second resistance is connected between the first and second conductors, the signal generator including electrical circuitry connected to at least one of the first and second conductors so that when the first switch is closed the first resistance is incorporated into the circuitry to cause the first predetermined period variation in the output signals and when the second switch is closed the second resistance is incorporated into the circuitry to cause the second predetermined period variation in the output signals In another embodiment, the present invention comprises a toy doll assembly including a toy doll and a separate tethered remote control unit electrically connected to the toy doll only by a two conductor cord comprising an electronic control unit within the toy doll, the electronic control unit including a signal generator for generating output signals and a controller for receiving the output signals and controlling the illumination of at least one LED associated with each eyes and at least one LED associated with the lip of the doll by detecting predetermined period variations in the received output signals, the illumination of the at least one LED associated with a first eyelid being enabled upon the detection of a first predetermined period variation in the output signals, the illumination of the at least one LED associated with the second eyelid being enabled upon the detection of a second predetermined period variation in the output signals and the illumination of the at least one LED associated with the lips being enabled upon the detection of a third predetermined period variation in the output signals, and the remote control unit electrically connected to the signal generator only by first and second electrical conductors of the cord, the remote control unit including a switch array having at least a first switch in series with a first resistance connected in parallel with a second switch in series with a second resistance and connected in parallel with a third switch in series with a third resistance, the switch array being connected between the first and second conductors so that when the first switch is closed the first resistance is connected between the first and second conductors, when the second switch is closed the second resistance is connected between the first and second conductors and when the third switch is closed the third resistance is connected between the first and second conductors, the signal generator including electrical circuitry connected to at least one of the first and second conductors so that when the first switch is closed the first resistance is incorporated into the circuitry to cause the first predetermined period variation in the output signals, when the second switch is closed the second resistance is incorporated into the circuitry to cause the second predetermined period variation in the output signals and when the third switch is closed the third resistance is incorporated into the circuitry to cause the third predetermined period variation in the output signals.

In yet another embodiment the present invention comprises an apparatus capable of performing at least two controlled actions comprising an electronic control unit within the apparatus, the electronic control unit including a signal generator for generating output signals and a controller for receiving the output signals and controlling the at least two actions by detecting predetermined period variations in the received output signals, a first action being enabled upon the detection of a first predetermined period variation in the output signals and a second action being enabled upon the detection of a second predetermined period variation in the output signals and a remote control unit separate from the electronic control unit and electrically connected to the signal generator only by a cord having only first and second electrical conductors, the remote control unit including a switch array having at least a first switch in series with a first resistance connected in parallel with a second switch in series with a second resistance, the switch array being connected between the first and second conductors so that when the first switch is closed the first resistance is connected between the first and second conductors and when the second switch is closed the second resistance is connected between the first and second conductors, the signal generator including electrical circuitry connected to at least one of the first and second conductors so that when the first switch is closed the first resistance is incorporated into the circuitry to cause the first predetermined period variation in the output signals and when the second switch is closed the second resistance is incorporated into the circuitry to cause the second predetermined period variation in the output signals

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
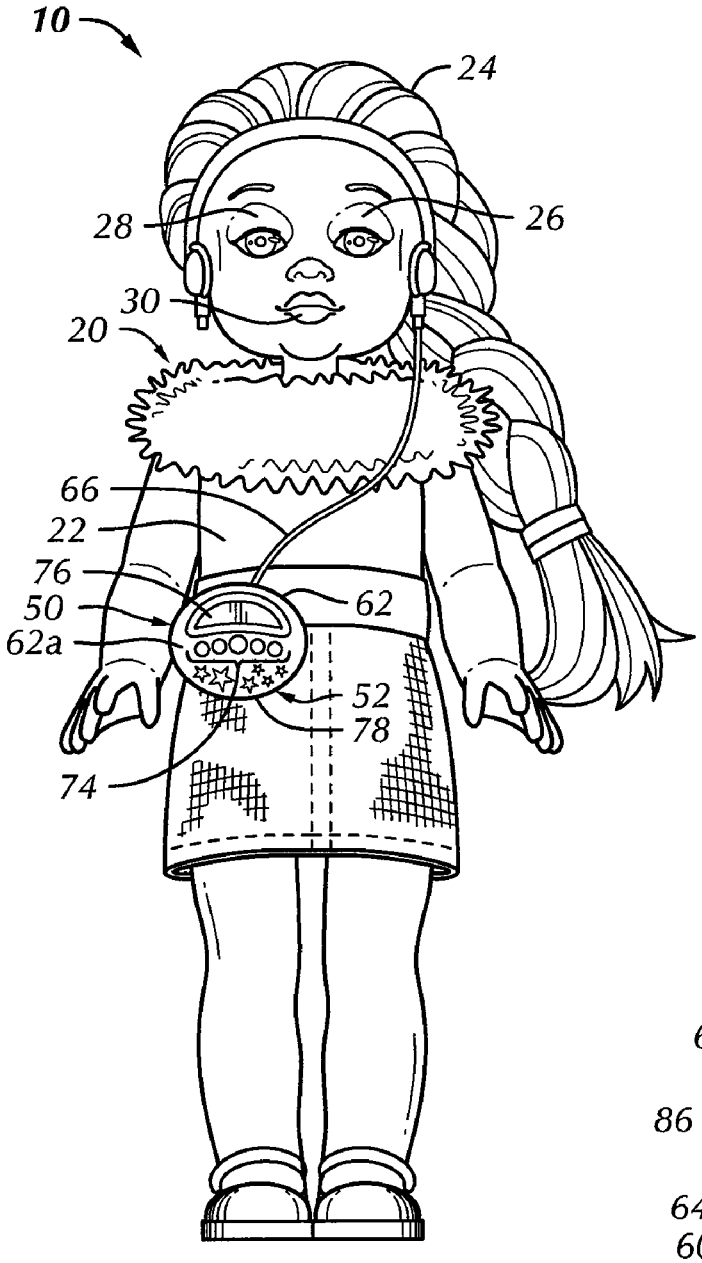
FIG. 1 is a front elevation view of toy doll assembly in accordance with a preferred embodiment of the present invention, showing a tethered remote control in a CD player configuration.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the doll assembly and designated parts thereof. The terminology includes the words specifically mentioned, derivatives thereof and words of similar import. Additionally, the word "a" as used in the specification means "at least one."

Figure 2:
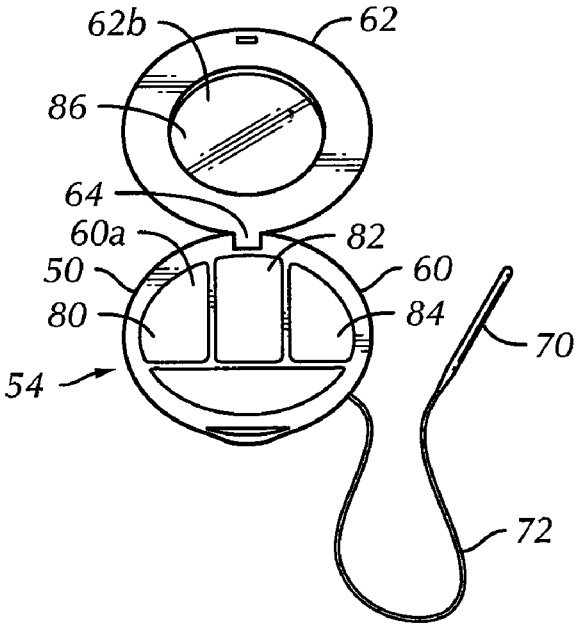
FIG. 2 top plan view of the tethered remote control of FIG. 1 shown in a make-up kit configuration.
Figure 3:
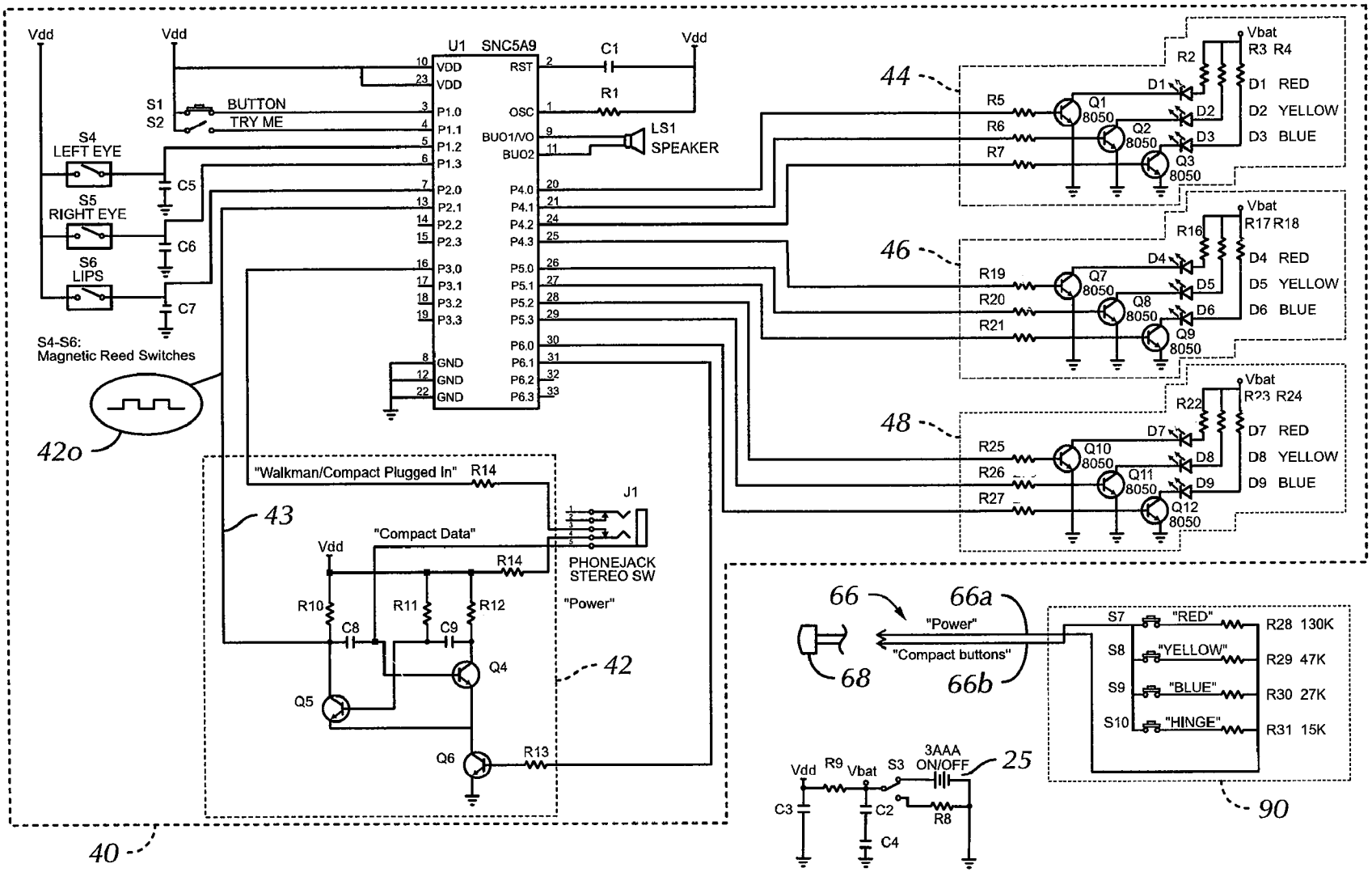
FIG. 3 is a circuit diagram of the toy doll assembly of FIG. 1.

Referring to the drawings in detail, wherein like numeric and alpha-numeric identifiers indicate like elements throughout the several figures, there is shown in FIGS. 1-5 preferred embodiments of a toy doll assembly or apparatus, generally designated 10, in accordance with the present invention. With reference initially to FIGS. 1-3, the toy doll assembly 10 includes a toy doll 20 and a separate, spaced apart tethered remote control unit 50. The remote control unit 50 is convertible as hereinafter described between a simulated CD player configuration 52 (FIG. 1), including a generally flat, circular base 60 hinge connected to an openable lid 62 (shown closed in FIG. 1), and a simulated make-up kit configuration 54 (FIG. 2), wherein the lid 62 is pivoted about the hinge 64 to an open position away from the base 60.

The toy doll 20 is generally conventional and includes a body 22 having a head 24. A speaker LS1 (FIG. 3) is mounted within the doll body 22 for playing music and other sounds. A power supply 25 (FIG. 3) preferably including conventional batteries, is also located within the doll body 22, preferably within the head 24. An on/off switch S3 (FIG. 3) is also mounted to the doll body 22, at an accessible location along with a music activation switch S1 (FIG. 3), and a "try-me" switch S2 (FIG. 3). An electrical connector receptacle, preferably a conventional phone jack receptacle J1 (FIG. 3), is also mounted to the doll body 22 at an accessible location, such as at or near the ear of the toy doll head 24 for connection to the tethered remote control unit 50. It will be appreciated that any other suitable type of connector may alternatively be employed or the tethered remote control unit 50 may be permanently secured to the toy doll body 22. Also, the tethered remote control unit 50 may be connected at some other location on the toy doll body 22. The doll head 24 is provided with a representation of a human face, including a left eyelid 26, a right eyelid 28, and lips 30.

The remote control unit 50 includes the base 60 and lid 62, connected together by a hinge 64 for relative pivotal movement between the closed simulated CD player configuration 52 as shown in FIG. 1 and the open simulated make-up kit configuration 54 as shown in FIG. 2. A hinge switch S10 (FIG. 3) is provided to allow detection of the position of the lid 62 relative to the base 60 i.e. whether the remote control unit 50 is in the closed or open configuration. A connection cord 66 allows the remote control 50 to be operatively electrically connected to an electronic control unit 40 (FIG. 3) which is housed within the toy doll body 22. The connection cord 66 includes only first and second electrical conductors 66*a*, 66*b*, respectively and no additional conductors. The connection cord 66 terminates in an electrical connector 68, adapted to be releasably received in the electrical connector receptacle J1 located on the toy doll head 24.

The remote control unit 50 further includes a magnetic wand 70, preferably connected to the base 60 by a tether 72. Operation of the wand 70 is discussed below. As shown in FIG. 1, on a first or outer face 62*a*, the lid 62 may be provided with one or more decorative (inactive) control buttons 74, a decorative (inactive) display 76 for simulation of a CD player and/or decorative indicia 78, such as the stars illustrated. On a second or inner face 62*b*, the lid 62 is preferably provided with a mirror 86, visible to a user with the remote control unit 50 in the make-up kit configuration 54. First, second, and third color selection switch panels 80, 82, and 84, respectively, are provided on a first or inner face 60*a* of the base 60. The switch panels 80-84 are simulative of make up and are color coded, for example, the first switch panel 80 corresponding to the color red, the second switch panel 82 corresponding to the color yellow, and the third switch panel 84 corresponding to the color blue. Of course, any desired combination of colors could be assigned to the switch panels 80-84. The first, second, and third switch panels 80, 82, and 84 cover corresponding first, second, and third color selection switches S7, S8, and S9 (FIG. 3). Operation of the switch panels 80-84 and the corresponding switches S7, S8 and S9 is discussed below.

With particular reference to FIG. 3, the electrical and electronic elements of the doll assembly 10 include the electronic control unit 40 housed within the doll body 22 and a switch array 90 housed in the remote control unit 50. The electronic control unit 40 includes a programmed microprocessor U1, preferably a SNC5A9 Two Channel Direct Drive Speech Controller microprocessor available from SONIX Technology Co., LTD. of Taiwan. The electronic control unit 40 further includes circuitry forming a signal or parameter generator such as a multivibrator 42. The signal generator 42 in the present embodiment generates square wave output signals 42*o* (shown in FIG. 3) which are passed along conductor 43 connected to pin 13 of the microprocessor U1. As discussed below, the output signals 42*o* allow determination by the microprocessor U1 of which of the first, second, and third color selection switches S7, S8, and S9 has been activated. It will be appreciated that some other type of signal generator could alternatively be employed and that the output signals could be something other than square waves.

The electronic control unit 40 further includes a left eyelid LED illumination assembly 44, a right eyelid LED illumination assembly 46, and a lips LED illumination assembly 48. The left eyelid LED illumination assembly 44 includes first, second, and third light emitting diodes (LEDs) D1, D2, and D3, respectively. Preferably, the LEDs D1-D3 emit light which is colored in correspondence with the switch panels 80-84. That is, if the first switch panel 80 is red, the first left eyelid LED D1 is also red, and so forth. The right eyelid LED illumination assembly 46 and lips LED illumination assembly 48 each also include a set of LEDs D4-D6 and D7-D9, respectively, which are similarly colored in correspondence with the switch panels 82 and 84, like the left eyelid LEDs D1-D3 (preferably red, yellow, and blue, respectively). It will be appreciated that other colors may be employed and that a lesser or greater number of color LEDs may be employed if desired.

A left eyelid magnetic switch S4 is positioned within the doll head 24 proximate to the left eyelid 26. Similarly, a right eyelid magnetic switch S5 and lips magnetic switch S6 are mounted within the doll head 24 proximate the right eyelid 28 and lips 30, respectively. Magnetic switches S4-S6 are preferably conventional magnetic reed switches known in the art. The magnetic switches S4-S6 are adapted to be activated when the magnetic wand 70 is brought into proximity to the switch.

The intensity or brightness of light emitted from the LEDs D1-D9 can be controlled, using any of various methods. First, the level of current supplied to the LED being illuminated can be adjusted up or down, resulting in more or less brightness. Second, the power provided to the LED can be modulated using a technique known in the art such as Pulse Width Modulation (PWM). Power to the LED is provided intermittently, being turned off and on at a high rate beyond the ability of the human eye to discern any flicker. As the duration of the "on" pulse increases, so does the intensity of the LED. A third and preferred method of controlling the LED illumination level is known in the art as Frequency Modulation, wherein the duration of a single "on" cycle over which power is supplied to the LED is constant, but the frequency of "on" cycles is increased to increase the LED brightness. In the present embodiment, the signals from the switches S4, S5, and S6 are sent to the microprocessor U1 to control the intensity of the various LEDs as will be described below.

With continued reference to FIG. 3, the remote control unit 50 includes the switch array 90, comprising the first, second, and third color selection switches S7, S8, and S9, respectively, along with a hinge switch S10 which is closed when the lid 62 is opened. The four switches S7-S10 are all connected in parallel across the two conductors 66*a*, 66*b* of connection cord 66. A first resistor R28, having a first resistance (preferably 130 kohms), is electrically connected in series with the first switch S7, a second resistor R29, having a second resistance (preferably 47 kohms) is electrically connected in series with the second switch S8, and a third resistor R30, having a third resistance (preferably 27 kohms) is electrically connected in series with the third switch S9. Still further, a fourth resistor R31, having a fourth resistance (preferably 15 kohms) is electrically connected in series with the hinge switch S10.

The electronic control unit 40 and remote control switch array 90 operate in conjunction to allow the microprocessor U1 to determine which of the first through third color selection switches S7-S9 has been activated, as well as determining whether the remote control 50 is in the closed or CD player configuration 52 or the open or make-up kit configuration 54, using only the two conductor connection cord 66. The signal generator 42 generates square wave output signals 42*o*. When one of the first, second, third or fourth switches S7-S10 is closed, the associated resistance R28-R31 is inserted into the circuitry of the signal generator 42 and changes the output signal 42*o* in a predetermined manner depending on which resistance R28-R31 has been inserted. In the present embodiment, the period during which the output signal 42*o* square wave is at a logical low level varies directly and in a predetermined detectable manner with the particular resistance of the first, second, third or fourth resistors R28, R29, R30 or R31 which is inserted into the circuitry. In particular, the duration of the low level portion of the square wave signal 42*o* is directly proportional to the resistance of the first through fourth resistors R28-R31. Therefore, by monitoring the output signals 42*o*, particularly the period or duration of the low level portions of the output signals, the microprocessor U1 can determine which of the first, second, third or fourth switches S7-S10 in the switch array 90 of the remote control unit 50 has been closed or activated. In this manner, the remote control unit 50 is capable of controlling various actions of the toy doll 20 using only the two conductor cord 66 connecting the remote control unit 50 to the toy doll 20.

In use, two operational modes are provided. In a first, musical operation mode, the remote control unit 50 is in the CD player configuration 52, with the lid 62 closed. With the remote control unit 50 connected to the doll 20, the user turns on the doll assembly 10 by activating the on/off switch S3. The user may then proceed to activate the music activation switch S1 to initiate playing of a musical passage though the speaker LS1. Following completion of the musical passage, and after a pre-determined time period of subsequent inactivity, the microprocessor U1 preferably causes enunciation of a message prompting the user to continue play activity. If the user fails to initiate additional play activity, the microprocessor U1 preferably causes an exit phrase to be enunciated, and the electronic control unit 40 enters an inactive state.

In a second "make-up" operational mode, with the remote control 50 operatively connected to the doll 20 and the on/off switch S3 activated, the user pivots the lid 62 to move the remote control 50 from the CD player configuration 52 to the make-up kit configuration 54. The position of the lid 62 is detected by the microprocessor U1 because of the closing of the hinge switch S10 which results in a detectable change in the output signal 42*o*. Upon the microprocessor detecting that the remote control unit 50 has been placed in the make-up kit configuration 54, the electronic control unit 40 and microprocessor U1 preferably cause enunciation of an introductory phrase, encouraging the user to select a color by pressing one of the three color selection switch panels 80-84. After the user has pressed one of the switch panels 80-84, preferably with the wand 70 (functioning as a play make-up applicator), the microprocessor U1 detects which switch panel 80-84 has been pressed by detecting another predetermined change in the output signal 42*o*, and which color selection switch S7-S9 has been activated, as discussed above. The microprocessor U1 preferably causes a phrase to be enunciated in response to the color selection, preferably encouraging the user to "apply make-up" to the doll 20 by touching the wand 70 to the doll's eyelids 26, 28 or lips 30.

If the user brings the magnetic wand 70 sufficiently close to one of the eyelids 26, 28 or lips 30, i.e. to the corresponding magnetic switches S4-S6 to activate the switch, the microprocessor U1 causes the LED D1-D9 corresponding to both the closed magnetic switch S4-S6 chosen (left eyelid, right eyelid, or lips) and to the color of the color selection switch panel 80-84 previously selected. That is, for example, if the user selected the first switch panel 80, corresponding, for example, to the color red, by touching the wand 70 to the first switch panel 80, and also chooses "to apply make-up" to the doll's lips 30 by touching the wand 70 to the doll's lips 30, the microprocessor U1 detects activation of first color selection switch S7 and the lips magnetic switch S6. The microprocessor U1 then cause the lips red LED D7 to be illuminated, thus creating an illusion of the application of red make-up to the doll's lips 30.

Upon touching of the eyelids 26 and 28 or lips 30 with the wand 70, the microprocessor U1 preferably also causes a phrase to be enunciated through the speaker LS1. For example, the phrase could compliment the user on the color selection or encourage the user to "apply additional make-up" by repeating the touching of the wand 70 to the eyelids 26, 28 or lips 30. To continue the example above, if the user touches the wand 70 to the doll's lips 30 a second time, the lips magnetic switch S6 is again activated, and the microprocessor U1 causes the brightness of LED D7 to be increased, preferably using the frequency modulation technique as discussed above. The electronic control unit 40 is preferably designed to produce three levels of brightness for LEDs D1-D9, thus allowing the user to make three discernable "applications of make-up" with increasing levels of brightness to the doll's eyelids 26, 28 or lips 30.

The user can also cause multiple LEDs to be illuminated simultaneously. For example, if the user touches the first color selection switch plate 80 (corresponding, for example, to the color red), and then activates the left eyelid magnetic switch S4 with wand 70, the left eyelid red LED D1 is caused to be illuminated at a first level of brightness. If the user then selects the second switch plate 82 (corresponding, for example, to the color yellow), and then again activates the left eyelid magnetic switch S4 with the wand 70, both the red LED D1 and the yellow LED D2 are illuminated at a first level of brightness. The red and yellow light emitted from the LEDs D1 and D2 tend to combine to create an orange color. Preferably, without any additional selection of another color selection switch panel, a second activation of the left eyelid magnetic switch S4 with wand 70 causes illumination of the yellow LED D2 to be increased to a second level, and the illumination of the red LED D1 to be decreased by one level (in the case of this example, to be turned off). Alternatively, the level of illumination of the red LED D1 could be maintained while the level of illumination of the yellow LED D2 is increased upon a second activation of the left eyelid magnetic switch.

During the make-up operational mode, the user can cause a song or portion of a song to be enunciated via speaker LS1 by pressing the music activation switch S1.

If, during or after a play sequence, the user fails to provide additional input within a predetermined period of time, the microprocessor U1 preferably causes an exit phrase to be enunciated. If no additional user input is detected within a second predetermined period of time, the doll assembly 10 enters the inactive state.

Alternatively, after an initial play sequence, the user can reset the electronic control unit 40, terminating illumination of all of the LEDs D1-D9, by closing the lid 62 on the remote control 50. Upon detection of the lid 62 being closed (via a signal from the hinge switch S10), the microprocessor U1 preferably causes a phrase and a song or portion of a song to be enunciated. Preferably, a second phrase encouraging the user to initiate another sequence of "make-up application" play activity will be enunciated. If the user fails to initiate another sequence of play activity, the microprocessor U1 will preferably cause an exit phrase to be enunciated, and if no additional user input is received, the doll assembly 10 will enter the inactive state.

Figure 4:
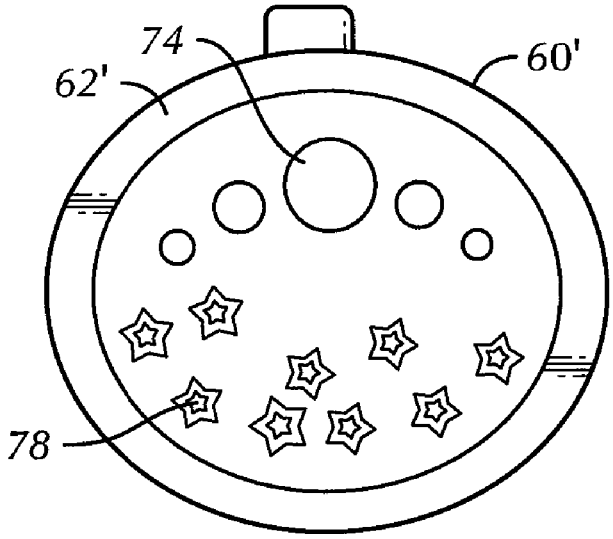
FIG. 4 is a top plan view of a second preferred embodiment of a lid of the tethered remote control of the toy doll assembly of FIG. 1.
Figure 5:
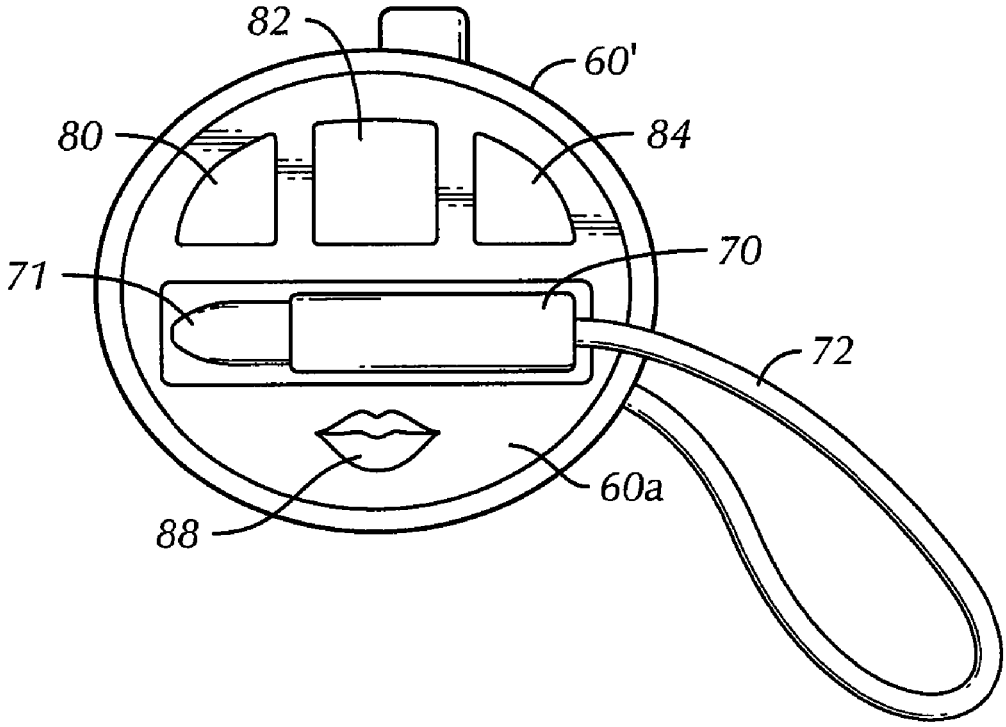
FIG. 5 is a top plan view of a second preferred embodiment of a base of the tethered remote control of the toy doll assembly of FIG. 1.

With reference now to FIGS. 4 and 5, a second embodiment base 60' and second embodiment lid 62' are generally similar in structure and operation to the first embodiment base 60 and first embodiment lid 62. One difference is that the hinge switch S10 is reconfigured in the second embodiment base and lid 60', 62' to be activated by contact or lack of contact between the second embodiment base and lid 60, 62'. Specifically, with the second embodiment base and lid 60', 62' closed, the lid 62' (or preferably a protrusion extending therefrom) presses against a preferably decorative switch plate 88 operatively coupled to hinge switch S10, while with the lid 62' rotated away from the base 60', the lid 62' does not contact the switch plate 88, and hinge switch S10 is released. Hinge switch S10 is closed with the lid 62 closed and the remote control 50 in the CD player configuration 52. Hinge switch S10 is open with the lid 62 pivoted away from the base 60, and the remote control 50 in the make-up kit configuration 54. In the embodiment illustrated, the switch plate 88 is in the shape of stylized lips. Operation of the hinge switch S10 using switch plate 88 is a preferred implementation. Furthermore, the magnetic wand 70 is shown to include a tip 71 (see FIG. 5).

A doll assembly is thus disclosed, requiring only two conductors to transmit data from a tethered remote control unit 50 to an electronic control unit 40 to communicate status of multiple input switches S7-S10 contained in the remote control unit 50. The doll assembly 10 further discloses a toy doll 20 providing novel play activities. It will be appreciated by those skilled in the art that changes could be made to the preferred embodiments of the toy doll assembly 10 described above without departing from the broad inventive concept thereof. It is understood, therefore, that this invention is not limited to the particular embodiment disclosed, but is intended to cover modifications within the spirit and scope of the present invention as defined by the appended claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy doll assembly including a toy doll and a separate tethered remote control unit electrically connected to the toy doll only by a two conductor cord comprising:

an electronic control unit within the toy doll, the electronic control unit including a signal generator for generating output signals and a controller for receiving the output signals and controlling at least two actions of the doll by detecting predetermined period variations in the received output signals, a first action being enabled upon the detection of a first predetermined period variation in the output signals and a second action being enabled upon the detection of a second predetermined period variation in the output signals; and the remote control unit electrically connected to the signal generator only by first and second electrical conductors of the cord, the remote control unit including a switch array having at least a first switch in series with a first resistance connected in parallel with a second switch in series with a second resistance, the switch array being connected between the first and second conductors so that when the first switch is closed the first resistance is connected between the first and second conductors and when the second switch is closed the second resistance is connected between the first and second conductors, the signal generator including electrical circuitry connected to at least one of the first and second conductors so that when the first switch is closed the first resistance is incorporated into the circuitry to cause the first predetermined period variation in the output signals and when the second switch is closed the second resistance is incorporated into the circuitry to cause the second predetermined period variation in the output signals.

2. The toy doll assembly as recited in claim 1 wherein the output signal is a square wave.

3. The toy doll assembly as recited in claim 1 wherein the remote control unit simulates a make up kit.

4. The toy doll assembly as recited in claim 1 wherein at least one of the at least two actions include illuminating at least one LED simulating make up on at least one of eyelids and lips of the toy doll.

5. The toy doll assembly as recited in claim 4 further including a switch within the toy doll beneath the at least one of the eyelids and lips, user activation of the switch causing the controller to vary the intensity of the at least one LED.

6. The toy doll assembly as recited in claim 5 wherein the switch is a magnetic reed switch and wherein the remote control unit includes a magnetic member configured to be manually removable from the remote control unit and manually applied by a user to the at least one of the eyelids and lips to provide selective manual activation of the switch by the user.

7. The toy doll assembly as recited in claim 4 wherein there are a set of three LEDs associated with each of the eyelids and the mouth of the doll, each of the LEDs of a set being of a different color.

8. The toy doll assembly as recited in claim 7 wherein the make up kit includes a plurality of switch panels, each different color of each of the three LEDs of the set being user selected by a different one of the plurality of switch panels.

9. The toy doll assembly as recited in claim 1 wherein the controller comprises a programmed microprocessor.

10. The toy doll assembly as recited in claim 1 wherein the remote control unit is simulative of a CD player.

11. The toy doll assembly as recited in claim 1 wherein an end of the cord distal to the remote control unit includes a connector and the toy doll includes a complimentary connector for connecting the end of the cord to the toy doll.

12. A toy doll assembly including a toy doll and a separate tethered remote control unit electrically connected to the toy doll only by a two conductor cord comprising:

an electronic control unit within the toy doll, the electronic control unit including a signal generator for generating output signals and a controller for receiving the output signals and controlling the illumination of at least one LED associated with each eyes and at least one LED associated with the lip of the doll by detecting predetermined period variations in the received output signals, the illumination of the at least one LED associated with a first eyelid being enabled upon the detection of a first predetermined period variation in the output signals, the illumination of the at least one LED associated with the second eyelid being enabled upon the detection of a second predetermined period variation in the output signals and the illumination of the at least one LED associated with the lips being enabled upon the detection of a third predetermined period variation in the output signals; and the remote control unit electrically connected to the signal generator only by first and second electrical conductors of the cord, the remote control unit including a switch array having at least a first switch in series with a first resistance connected in parallel with a second switch in series with a second resistance and connected in parallel with a third switch in series with a third resistance, the switch array being connected between the first and second conductors so that when the first switch is closed the first resistance is connected between the first and second conductors, when the second switch is closed the second resistance is connected between the first and second conductors and when the third switch is closed the third resistance is connected between the first and second conductors, the signal generator including electrical circuitry connected to at least one of the first and second conductors so that when the first switch is closed the first resistance is incorporated into the circuitry to cause the first predetermined period variation in the output signals, when the second switch is closed the second resistance is incorporated into the circuitry to cause the second predetermined period variation in the output signals and when the third switch is closed the third resistance is incorporated into the circuitry to cause the third predetermined period variation in the output signals.

13. The toy doll assembly as recited in claim 12 further including a switch within the toy doll which when actuated causes the controller to vary the intensity of an illuminated LED.

14. The toy doll assembly as recited in claim 12 wherein the remote control unit in a first, closed configuration simulates a portable CD player and in a second, opened configuration simulates a make up kit.

15. The toy doll assembly as recited in claim 14 wherein the make up kit includes switch panels which are colored to correspond to the colors of the LEDs of a set.

16. The toy doll assembly as recited in claim 12 wherein the output signal is a square wave.

17. The toy doll assembly as recited in claim 12 wherein each of the at least one LED associated with each of the right eyelid, the left eyelid and the lips is further associated with at least two other LED in a set of at least three LEDs associated with each of the right eyelid, the left eyelid and the lips of the toy doll, at least three LEDs of each set being of a different color from one another.

18. An apparatus capable of performing at least two separate and different controlled actions comprising:

an electronic control unit within the apparatus, the electronic control unit including a signal generator configured to generate an oscillating output signal of predetermined period and a controller electrically connected with the signal generator to receive the oscillating output signal and configured to detect predetermined period variations from the predetermined period in the oscillating output signal, the controller further being configured to control the at least two actions of the apparatus in response to detected predetermined period variations in the oscillating output signal, a first action being performed by the apparatus under control of the controller upon detection by the controller of a first predetermined period variation in the oscillating output signal and a second action being performed by the apparatus under control of the controller upon the detection by the controller of a second predetermined period variation in the oscillating output signal different in magnitude from the first predetermined period variation; and a remote control unit located outside of the apparatus separate and separated from the electronic control unit and electrically connected in circuit with the signal generator between the signal generator and the controller within the apparatus by a cord having first and second electrical conductors, the remote control unit including a switch array having at least a first switch in series with a first resistance connected in parallel with a second switch in series with a second resistance, the first and second resistances having magnitudes different from one another, the switch array being connected between the first and second conductors so that the first resistance is connected between the first and second conductors and by the first and second conductors in circuit with the signal generator by closure of the first switch to cause the first predetermined period variation in the oscillating output signal, the first predetermined period variation being dependent upon the magnitude of the first resistance, and the second resistance is connected between the first and second conductors and by the first and second conductors in circuit with the signal generator by closure of the second switch to cause the second predetermined period variation in the oscillating output signal, the second predetermined period variation being dependent upon the magnitude of the second resistance.

19. The apparatus of claim 18 wherein:

the apparatus is configured to perform a third action different from the first and second actions under control of the controller upon the detection by the controller of a third predetermined period variation in the oscillating output signal different from the first and second predetermined period variations; and the switch array of the remote control unit includes a third switch in series with a third resistance, the third resistance differing in magnitude from first and second resistances, and the third resistance is connected between the first and second conductors and by the first and second conductors in circuit with the signal generator by closure of the third switch to cause the third predetermined period variation in the oscillating output signal.

20. The apparatus as recited in claim 19 wherein the controller comprises a programmed microprocessor.

21. The apparatus as recited in claim 19 wherein the signal generator is a square wave generator.

22. The apparatus as recited in claim 18 wherein the controller comprises a programmed microprocessor.

23. The apparatus as recited in claim 18 wherein the signal generator is a square wave generator.

24. The apparatus as recited in claim 18 further including at least two LEDs which are illuminated as the controlled actions.

* * * * *